US005976774A

United States Patent [19]

Uchihiro

[11] Patent Number: 5,976,774

[45] Date of Patent: Nov. 2, 1999

[54] SOLID PROCESSING COMPOSITION FOR SILVER HALIDE LIGHT SENSITIVE PHOTOGRAPHIC MATERIAL AND PREPARING METHOD THEREOF

[75] Inventor: Shinji Uchihiro, Hino, Japan

[73] Assignee: Konica Corporation, Tokyo, Japan

[21] Appl. No.: 09/107,150

[22] Filed: Jun. 30, 1998

[30] Foreign Application Priority Data

Jul. 1, 1997 [JP] Japan ..... 9-190440

[51] Int. Cl.[6] ..... G03C 5/50

[52] U.S. Cl. ..... 430/465; 430/450; 430/458

[58] Field of Search ..... 430/465, 458, 430/450

[56] References Cited

U.S. PATENT DOCUMENTS

| | | | |
|---|---|---|---|
| 5,336,588 | 8/1994 | Ueda | 430/465 |
| 5,587,277 | 12/1996 | Yamashita et al. | 430/465 |
| 5,635,342 | 6/1997 | Deguchi | 430/465 |
| 5,707,790 | 1/1998 | Yanagisawa | 430/465 |
| 5,866,310 | 2/1999 | Ishida | 430/465 |

FOREIGN PATENT DOCUMENTS

| | | |
|---|---|---|
| 0367339A2 | 5/1990 | European Pat. Off. . |
| 0547796A1 | 6/1993 | European Pat. Off. . |
| 0636930A1 | 2/1995 | European Pat. Off. . |
| 0667559A1 | 8/1995 | European Pat. Off. . |
| 0678782A1 | 10/1995 | European Pat. Off. . |

OTHER PUBLICATIONS

European Search Report Oct. 1998.

*Primary Examiner*—Hoa Van Le

*Attorney, Agent, or Firm*—Finnegan, Henderson, Farabow, Garrett & Dunner, L.L.P.

[57] ABSTRACT

A method for preparing a solid processing composition in the form of granules for a silver halide black-and-white photographic material is disclosed, comprising the steps of:

(i) mixing powdery photographic processing chemicals, (ii) granulating a mixture of the processing chemicals while stirring to form granules, and (iii) drying the granules, wherein in step (ii), granulation is carried out with the addition of water in an amount of 4 to 6% by weight, based on the processing chemicals; said granules having a bulk density of not less than 1.1 g/cm$^3$.

5 Claims, No Drawings

SOLID PROCESSING COMPOSITION FOR SILVER HALIDE LIGHT SENSITIVE PHOTOGRAPHIC MATERIAL AND PREPARING METHOD THEREOF

FIELD OF THE INVENTION

The present invention is related to a solid processing composition for a silver halide light sensitive photographic material and a preparing method thereof.

BACKGROUND OF THE INVENTION

A silver halide light sensitive photographic material (hereinafter, also simply referred to as photographic material), after exposure, is processed according to the process, such as developing, fixing, washing and stabilizing. Processing is carried out conventionally using an automatic processor, in which, in general, a replenishing solution is replenished so that activity of a processing solution is constantly maintained. The replenishment is intended to dilute the concentrations of materials leached out of the photographic material, to correct for the evaporating amount and to replenish consumed components.

The processing solution is conventionally prepared diluting processing chemical concentrates with water. Recently, the silver halide photographic material can also be continuously processed with supplying a solid processing composition.

The solid processing compositions is generally divided into two or more parts. In the method which is generally used in practice for preparing the solid processing composition, however, problems arise such as dust being easily produced; and when the granular size is varied, the stability of the preparation is lowered; and further when subjected to running process, marked staining occurs. Further, another serious problem also arises, such as marked deterioration in the drying speed of the processed photographic materials.

The solid processing composition was deteriorated in hardness and abrasion resistance so that significant dust was produced in usage thereof, leading to handling problems and harmful physiological effects. Accordingly, there has been a strong desire to solve the foregoing problems.

SUMMARY OF THE INVENTION

It is an object of the present invention to provide a solid processing composition for a silver halide light sensitive photographic material which is not deteriorated in photographic performance and produce no stain during running processing, does not give rise to dust at the time of the use thereof, and a method for preparing the solid processing composition.

The above object of the present invention can be accomplished by the following constitutions:

(1) a method for preparing a solid processing composition in the form of granules for a silver halide light sensitive black-and-white photographic material, said method comprising the steps of:
  (i) mixing powdery photographic processing chemicals,
  (ii) granulating a mixture of the processing chemicals while stirring to form granules, and
  (iii) drying the granules wherein in step (ii), granulation is carried out with the addition of water in an amount of 4 to 6% by weight, based on the processing chemicals; the resulting granules having a bulk density of not less than 1.1 g/cm$^3$;

(2) The preparation method described in (1), wherein in step (ii), granulation is carried out while stirring at a rate of 100 to 300 rpm;

(3) The preparation method described in (1), wherein the granules have an average particle size of 100 $\mu$m to 800 $\mu$m;

(4) The preparation method described in (1), wherein the solid processing composition in the form of granules is further subjected to compression-molding to form tablets.

(5) The preparation method described in (1), wherein the solid processing composition in the form of granules is a developing composition or a fixing composition.

(6) The preparation method described in (1), wherein the solid processing composition in the form of granules contains gluconic acid or its derivative.

(7) The preparation method described in (4), wherein the solid processing composition in the form of tablets has a hardness of not less than 40 Kg and a degree of abrasion of not more than 3%.

DETAILED DESCRIPTION OF THE INVENTION

The solid processing composition for a silver halide photographic material according to the invention includes one in the form of a powder, granules or tablets. According to the present invention, the powder refers to an aggregate of fine crystal particles; the granules refers to granulates prepared by subjecting the powder to a granulating process and having a granular size of 50 $\mu$m to 5,000 $\mu$m. Tablets are obtained by subjecting the powder or the granules to compression-molding to a prescribed form.

The granules can be prepared by any of several methods known in the art, such as rolling granulation, extruding granulation, compressing granulation, pulverizing granulation, stirring granulation, fluidized bed granulation and spray-drying granulation. Of these, according to the invention, the stirring granulation is preferred, whereby the bulk density of the granules can easily be controlled. Generally used in the stirring granulation is a mixer having a cylindrical vessel provided with stirring blades. The shape or the number of stirring blades are optionally selected in accordance with the purpose thereof. The blades in the cylindrical vessel are conventionally provided on upper and lower sides and rotated at a relatively high speed. The mixer preferably employed is e.g., a Henschell mixer. The Henschell mixer is a rotary stirring granulator, comprising a cylindrical vessel in which a sealing portion is provided at the bottom. According to the invention, the stirring granulation is carried out by stirring preferably at a rate of 100 to 300 rpm. Further, it is preferred to use a stirring granulator which meets the following conditions:

$$0.005 \leqq t \leqq 0.5$$

where t is a mixing efficiency parameter, represented in terms of L/V, in which V is the volume of the vessel of the granulator, expressed in liter, and L is the diameter of the stirring blade, expressed in meter.

The stirring granulation is a process employing the agglomeration property of the powder, that is, a process of incorporating a powder, together with a binder into a vessel and forming granules while stirred with a blade. Thus, the method for preparing a solid processing composition in the form of granules according to the invention is characterized in that photographic processing chemicals are separately or together ground down to a fine particle powder, and then subjected to a powder agglomeration with the addition of a granulating liquid, e.g., water, and a binder, while stirring.

The process for preparing the granules according to the invention will now be described in detail. Given amounts of such processing chemicals each are weighed. In this case, a substance in the form of blocks are previously pulverized to powdery particles, using a commercial mill. The chemicals are introduced into a stirring granulator and mixed while stirring at a rate of 100 rpm for 3 min. Then, the mixture is further stirred at a rate between 200 and 300 rpm while spraying on this mixture water containing a binder, which is used as a granulating liquid, in an amount of 4 to 6% by weight, based on the chemicals, within 60 sec. (preferably, 40 to 60 sec.), and stirring continues further for 3 to 6 min. Subsequently, after stirring at a rate of 100 rpm for 1 min., granules are discharged while stirring. The granules are introduced into a drying apparatus and dried using a drying apparatus. The drying apparatus preferably employed is a commercial fluidized bed granulater, such as Multi-Prex series, GPCG series and WST/WSG series available from Pawlex Corp.; the New Mulmerizer series available from Fuji Powdall Corp.; the Mix-grad series available from Ohkawara Seisakusho; and the Spira-Flow series and the Flow-Coater series available from Freund Corp. The granules are dried in the fluidized bed granulator by heating of the fluidized air to from 40 to 70° C. (preferably, 50 to 60° C.) over a period of 30 min. to 3 hr. until the moisture content of the granules reaches 0.5 to 3% (preferably 1 to 2%).

The granules are generally subjected to dressing by means of a commercially available dressing machine, e.g., MICRO-PULVERRIZER type AP-B available from Hosokawa Micron Corp. In this case, the granular size can be controlled by varying the frequency at the time of pulverization and the mesh of the internal screen. The granule size can be measured by a screening method based on JIS Standards. The average size of the granules obtained by the method according to the invention is preferably 100 to 800 $\mu$m, and more preferably 200 to 750 $\mu$m, a size which, when mixed and subjected to compression-molding to form tablets, cause hardly any non-uniform distribution of components, so-called aggregation. The size distribution is preferably one in which at least 60% of the total granules is within the deviation range of ±100 to 150 $\mu$m.

The granules are preferably further subjected to compression-molding to form tablets, using a conventional compressing machine, such as an oil hydraulic press, a single tableting machine, a rotary tableting machine or a briquetting machine. The thus formed tablets may be in any form. The solid processing composition in the form of tablets is preferably used in terms of being accurately replenished and easy to handle. The tablets which are formed by the process of granulating a powdery processing chemicals and subjecting the resulting granules to tableting result in improvements in solubility and storage stability, leading to stable and superior photographic performance.

Each component, such as an alkaline agent, a reducing agent or a preservative may be separately granulated.

The granular processing composition can also be prepared according to the methods described in JP-A 109042, 109043, 3-39735 and 3-39739 (herein, the term, JP-A refers to unexamined published Japanese Patent Application).

The bulk density according to the invention is generally defined as:

$$\text{Bulk density} = M/V$$

where M represents the weight of a powder or granules and V represents the volume of the powder or granules. There are a few methods for measuring the bulk density, and a horizontal vibration bulk density measuring method, which is small in fluctuation, is accepted in the present invention.

Requirements for measuring the bulk density are as follows:

1. a powder or granules are filled into a vessel according to the fixed conditions;
2. a powder or granules are dropped in a prescribed state and at a prescribed speed, i.e., dropping is uniformly made; and
3. a heaping full of a powder or granules in a vessel is removed by an automatic means, instead of using a glass rod.

The bulk density of the solid processing composition according to the invention is preferably not less than 1.0 g/cm$^3$, and more preferably not less than 1.1 g/cm$^3$ for optimal solubility and effects of the invention. The bulk density is still more preferably 1.1 to 1.3 g/cm$^3$. A bulk density of less than 1.0/cm$^3$ is not preferred due to deteriorated hardness and abrasion resistance.

Next, photographic processing solutions to which the solid processing composition according to the invention is applied, will be described. A developing solution used in the invention may contain a sulfite or a metabisulfite, as a preservative, including sodium sulfite, ammonium sulfite and sodium metabisulfite. The sulfite is contained preferably in an amount of not less than 0.25 mol/l, and more preferably not less than 0.4 mol/l. The developing solution preferably further contain an alkaline agent (e.g., sodium hydroxide, potassium hydroxide, etc.) and a pH buffering agent (e.g., a carbonate, a phosphate, a borate, acetic acid, citric acid, alkanol amine, etc.). The pH buffering agent is preferably a carbonate, which is preferably contained in an amount of 0.5 to 2.5 mol/l, and more preferably 0.75 to 1.5 mol/l. The developing solution may further contain a dissolving aid (e.g., polyethylene glycols and their esters, alkanol amines, etc.), a sensitizing agent (e.g., nonionic surfactants including polyoxyethylenes, quaternary ammonium compounds, etc.), a surfactant, a defoaming agent, an antifoggant (e.g., halides such as potassium bromide and sodium bromide, nitrobenzindazoles, nitrobenzimidazoles, benztriazoles, benztetrazoles, tetrazoles, thiazoles, etc.), a chelating agent (e.g., ethylenediaminetetraacetic acid and its alkaline metal salt, nitrilotriacetates, polyphosphates, etc.), a development accelerating agent (e.g., compounds described in U.S. Pat. No. 2,304,025 and JP-B 47-45541, etc.) or a hardening agent (e.g., glutar aldehyde and its adduct with a metabisulfite, etc.). The pH of the developing solution is preferably not less than 8.5 and not more than 11.0.

The developer effluent can be electrolytically regenerated. Exemplarily, putting a cathode (an electric conductor such as stainless steal wool or a semiconductor) into the developer effluent, and an anode (a non-dissolvable electric conductor, such as carbon, gold, platinum, or titanium) into an electrolyte, a developer effluent bath is brought into contact, through an anion exchange resin, with an electrolyte bath and then electric current is applied between both electrodes to regenerate the developer. In this case, added thereto may be adjuvants to be added to the developing solution, such as a preservative, an alkaline agent, a pH buffering agent, a sensitizing agent, an antifoggant or a silver sludge-preventing agent. A technique of processing a photographic material by applying an electric current is also known, in which the adjuvants described above may be added thereto. In cases where employing a renewed developing solution, transition metal complex salts are preferably used as a developing agent.

As a specific type of development, activator processing may be applied, in which a developing agent is allowed to be contained in a photographic material, e.g., an emulsion layer or a layer adjacent thereto, and the photographic material is processed in an aqueous alkaline solution to cause development. The photographic material containing the developing agent, e.g., in an emulsion layer or an adjacent layer, may be processed in a developing solution. Such processing can be employed, as a means of rapid access of photographic materials, in combination with a silver salt stabilizing process by the use of a thiocyanate.

Next, a fixing solution will layer described. The fixing solution can be employed by dissolving one or more solid fixing composition comprised of two or more compounds, though conventionally employed by diluting a concentrated solution kit with water. It is preferred to dissolve one or more solid fixing composition comprised of two or more compounds to form a replenishing solution. The fixing solution is aqueous solution containing a thiosulfate and having a pH of 4.0 or more, preferably 4.2 to 5.5, and more preferably 4.2 to 5.3. A fixing agent includes sodium thiosulfate or ammonium thiosulfate, and ammonium thiosulfate is preferred in terms of the fixing speed. The amount of the fixing agent is optional, and preferably 0.1 to 6 mol/l. The fixing solution may contain an aqueous soluble aluminum salt, as a hardening agent. Examples thereof include aluminum sulfate and potassium alum. The fixing solution may further contain a preservative (e.g., sulfites, bisulfites, etc.), a pH adjusting agent (e.g., sulfuric acid, sodium hydroxide, etc.), a chelating agent capable of water-softening, or a compound described in JP-A 62-78551.

The solid processing composition according to the invention is employed to prepare the processing solution described above. The solid processing composition according to the invention is a solid formed of two or more components constituting the processing solution, which may be a single solid composition containing all of components of the processing solution, or two or more solid compositions each separately containing the components. The solid processing composition may comprise at least one solid formed of two or more compounds. Compound(s) other than those contained in the solid may in the form of a single body.

The photographic material is processed at a given replenishing rate in proportion to the area of the photographic material. The developer replenishing rate is preferably not more than 200 ml/m$^2$, and more preferably 50 to 190 ml/m$^2$. The fixer replenishing rate is preferably not more than 250 ml/m$^2$ and more preferably 50 to 190 ml/m$^2$. A developing or fixing replenisher may be the same solution as a developing or fixing mother liquor contained in a developing or fixing tank of an automatic processor, a different solution, or a solid developing or fixing composition. The developer replenishing rate or the fixer replenishing rate is a solution volume to be replenished. Thus, in cases where the same solution as a developing mother liquor or fixing mother liquor is replenished, the replenishing rate is the volume of each solution to be replenished. In cases where a developer concentrated solution and a fixer concentrated solution each are diluted with water and replenished, the replenishing rate is the volume sum of the concentrated solution and water. In cases where the solid processing composition is dissolved in water and replenished, the replenishing rate is the volume of the solution to be replenished. In cases where the solid processing composition and water each are separately replenished, the replenishing rate is the sum of the amount of the solid processing composition and the volume of water.

In the case of the solid processing composition, the amount to be supplied at one time is preferably 0.1 to 50 g. Thus, the solid developing and fixing compositions are supplied preferably in amounts of 1 to 20 g and 5 to 50 g, respectively. Even when processed by directly supplying such an amount of the solid processing composition to a processing bath of the processor and allowing the composition to be gradually dissolved, there occurs no adverse effect on photographic performance. Even when supplied in a large amount at one time, the solid processing composition is gradually dissolved and is well balanced with the consumed amount during processing, leading to stable photographic performance. It was also proved that replenishing water in accordance with the dissolution of the solid processing composition led to constantly high quality photographic performance. Processing solutions are maintained at a given processing temperature so that the dissolution speed of the solid processing composition is also maintained, achieving the prescribed supply of the solid processing composition and a balance of components.

The solid processing composition may be a granular form or a tablet form. A tablet is more preferable than granules, in terms of dissolution control.

The solid processing composition preferably contain a gluconic acid, including gluconic acid, its derivative or salt, or anhydride. The gluconic acid may be in the form of an alkali metal salt or ammonium salt. These compounds may used singly or in combination. The gluconic acid is preferably contained 0.005 to 0.07 mol, and more preferably 0.03 to 0.05 mol per liter of a processing solution. The gluconic acid may be used in combination with an organic acid such as malic acid, tartaric acid, citric acid, succinic acid, oxalic acid, maleic acid, glycolic acid, benzoic acid, salicylic acid, Tiron, ascorbic acid, glutaric acid or adipinic acid; amino acid such as asparagic acid, glycine or cystein; an aminocarboxylic acid such as ethylenediaminetetraacetic acid, diethylenetriaminepentaacetic acid, 1,3-propanediaminetetraacetic acid or nitrilotriacetic acid; or a saccharide. The gluconic acid is effective for preventing precipitation in concentration of a processing solution. Specifically, it is effective when preparing the solid processing composition in the form of a tablet.

The temperatures of developing, fixing and washing and/or stabilizing bath is preferably 10 to 45° C. The temperature of each bath may be independently controlled.

EXAMPLES

The present invention will be further explained, based on examples.

Preparation of Silver Halide Emulsion A

A silver bromochloride core grains having a chloride content of 70 mol %, an average grain thickness of 0.05 μm and an average grain diameter of 0.15 μm were prepared by the double jet method. During core grain formation was added $K_3RuCl_6$ in an amount of $8\times10^{-8}$ mol per mol of silver. The core grains were further shelled by the double jet method, in which $K_2IrCl_6$ of $3\times10^{-7}$ mol per mol of silver was added. The resulting emulsion was comprised of monodisperse (coefficient of variation of 10%), core/shell type silver iodobromochloride grains (90 mol % chloride, 0.2 mol % iodide) tabular grains having an average thickness of 0.10 μm, average diameter of 0.25 μm and (100) major faces. The emulsion was cooled to 40° C., then, thereto was added 100 ml of 13.8% by weight of polymeric coagulant, phenylcarbamoyl group-modified gelatin (percentage of substitution of 90%) and stirring further continued for 3 min. Subsequently, after the emulsion was adjusted to a pH of 4.6 with an aqueous 56% by weight acetic acid solution and stirred for 3 min., the emulsion was allowed to stand for 20 min. and the supernatant was removed by decantation. Thereafter, 9.0 liters of distilled water at 40° C. was added thereto, after stirred and allowed to stand, the supernatant was removed, 11.25 liters of distilled water was further added, and after stirred and allowed to stand, the supernatant was removed. Subsequently, an aqueous gelatin solution was added, the pH was adjusted to 5.80 with an aqueous 10% by weight sodium carbonate solution, and stirring continued for 30 min. at 50° C. to redisperse. After redispersion, the pH and pAg were adjusted to 5.80 and 8.06 at 40° C. The EAg of the desalted emulsion was 190 mV at 50° C.

To the resulting emulsion was added 4-hydroxy-6-methyl-1,3,3a,7-tetraazaindene of $1\times10^{-3}$ mol per mol of silver, and the pH and EAg were adjusted to 5.6 and 123 mV, respectively, with potassium bromide or citric acid. Then, adding sodium p-toluenethiosulfonate of $1\times10^{-3}$ mol, chloramine T of 350 mg, sulfur single body ($S_8$) of 0.6 mg and trichloroaurate of 6 mg, the emulsion was chemically ripened at 60° C. until reached the maximum sensitivity. After completing chemical ripening were added 4-hydroxy-6-methyl-1,3,3a,7-tetraazaindene of $2\times10^{-3}$ mol per mol of silver, 1-phenyl-5-mercaptotetrazole of $3\times10^{-4}$ and potassium iodide of 300 mg.

Preparation of Silver Halide Emulsion A

A silver iodobromochloride core grains having a chloride content of 60 mol %, an iodide content of 2.5 mol %, an average grain thickness of 0.05 μm and an average grain diameter of 0.15 μm were prepared by the double jet method. During core grain formation was added $K_3Rh(H_2O)Br_5$ in an amount of $2\times10^{-8}$ mol per mol of silver. The core grains were further shelled by the double jet method, in which $K_2IrCl_6$ of $3\times10^{-7}$ mol per mol of silver was added. The resulting emulsion was comprised of monodisperse (coefficient of variation of 10%), core/shell type silver iodobromochloride grains (90 mol % chloride, 0.5 mol % iodide) tabular grains having an average thickness of 0.10 μm and average diameter of 0.42 μm. The resulting emulsion was desalted using a modified gelatin (in which an amino group of the gelatin was substituted with a phenylcarbamyl, such as Compound G-8 exemplified in JP-A 2-280139). After desalting, the EAg was 190 mV at 50° C.

To the resulting emulsion was added 4-hydroxy-6-methyl-1,3,3a,7-tetraazaindene of $1\times10^{-3}$ mol per mol of silver, and the pH and EAg were adjusted to 5.6 and 123 mV, respectively, with potassium bromide or citric acid. Then, adding chloroauric acid of $2\times10^{-5}$ mol and N,N,N'-trimethyl-N'-heptafluoroselenourea of $3\times^{-5}$ mol, the emulsion was chemically ripened at 60° C. until reached the maximum sensitivity. After completing chemical ripening were added 4-hydroxy-6-methyl-1,3,3a,7-tetraazaindene of $2\times10^{-3}$ mol per mol of silver, 1-phenyl-5-mercaptotetrazole of $3\times10^{-4}$ and gelatin.

Preparation of Silver halide Photographic Material for use in Plate-making Scanner with He—Ne Laser Light Source.

On one side of a subbed support were simultaneously coated a gelatin sublayer of Formula 1 with a gelatin coating amount of 0.5 g/m$^2$, silver halide emulsion layer 1 of Formula 2 with a silver coating amount of 1.5 g/m$^2$ and a gelatin coating amount of 0.5 g/m$^2$, an interlayer of Formula 3 with a gelatin coating amount of 0.3 g/M$^2$, silver halide emulsion layer 2 of Formula 4 with a silver coating amount of 1.4 g/m$^2$ and a gelatin coating amount of 0.4 g/m$^2$, and a protective layer of Formula 5 with a gelatin coating amount of 0.6 g/m$^2$, in this order. On the other side of the support, a backing layer with a gelatin coating amount of 0.6 g/m$^2$, a hydrophobic polymer layer of Formula 7, and a backing protective layer of Formula 8 with a gelatin coating amount of 0.4 g/m$^2$, in this order, were simultaneously coated with the emulsion layer side to form a photographic material sample.

Formula 1 (Gelatin Sublayer)

| | |
|---|---|
| Gelatin | 0.5 g/m$^2$ |
| Dye AD-1, solid particle dispersion (Av. particle size of 0.1 μm) | 25 mg/m$^2$ |
| Poly(sodium stylenesulfonate) | 10 mg/m$^2$ |
| S-1 (sodium iso-amyl-n-decylsuccinate) | 0.4 mg/m$^2$ |

Formula 2 (Silver Halide Emulsion Layer 1)

| | |
|---|---|
| Silver halide emulsion A | 1.5 g/m$^2$, based on silver |
| Dye AD-8, solid particle dispersion (Av. particle size of 0.1 μm) | 20 mg/m$^2$ |
| Cyclodextrin (hydrophilic polymer) | 0.5 g/m$^2$ |
| Sensitizing dye d-1 | 5 mg/m$^2$ |
| Sensitizing dye d-2 | 5 mg/m$^2$ |
| Hydrazine derivative HY-1 | 20 mg/m$^2$ |
| Nucleation accelerating agent AM-1 | 40 mg/m$^2$ |
| Redox compound RE-1 | 20 mg/m$^2$ |
| Compound e | 100 mg/m$^2$ |
| Latex polymer f | 0.5 mg/m$^2$ |
| Hardener g | 5 mg/m$^2$ |
| S-1 | 0.7 mg/m$^2$ |
| 2-Mercapto-6-hydroxypurine | 5 mg/m$^2$ |
| EDTA | 30 mg/m$^2$ |
| Colloidal silica (Av. particle size of 0.05 μm) | 10 mg/m$^2$ |

Formula 3 (Interlayer)

| | |
|---|---|
| Gelatin | 0.3 g/m$^2$ |
| S-1 | 2 mg/m$^2$ |

Formula 4 (Silver Halide Emulsion Layer 2)

| | |
|---|---|
| Silver halide emulsion B | 1.4 g/m$^2$, based on silver |
| Sensitizing dye d-1 | 3 mg/m$^2$ |
| Sensitizing dye d-2 | 3 mg/m$^2$ |
| Hydrazine derivative HY-2 | 20 mg/m$^2$ |
| Nucleation accelerating agent AM-1 | 40 mg/m$^2$ |
| Redox compound RE-1 | 20 mg/m$^2$ |
| 2-Mercapto-6-hydroxypurine | 5 mg/m$^2$ |
| EDTA | 20 mg/m$^2$ |
| Latex polymer f | 0.5 mg/m$^2$ |
| S-1 | 1.7 mg/m$^2$ |

Formula 5 (Emulsion Protective Layer)

| | |
|---|---|
| Gelatin | 0.6 g/m$^2$ |
| Dye b, solid particle dispersion (Av. particle size of 0.1 μm) | 40 mg/m$^2$ |
| S-1 | 12 mg/m$^2$ |
| Mating agent, monodispersed Silica (Av. particle size of 3.5 μm) | 25 mg/m$^2$ |
| 1,3-vinylsulfonyl-2-propanol | 40 mg/m$^2$ |
| Surfactant h | 1 mg/m$^2$ |
| Colloidal silica (Av. particle size of 0.05 μm) | 10 mg/m$^2$ |
| Hardener j | 30 mg/m$^2$ |

Formula 6 (Backing Layer)

| | |
|---|---|
| Gelatin | 0.6 g/m$^2$ |
| S-1 | 5 mg/m$^2$ |
| Latex polymer f | 0.3 g/m$^2$ |
| Colloidal silica (Av. particle size of 0.05 $\mu$m) | 70 mg/m$^2$ |
| Poly(sodium stylenesulfonate) | 20 mg/m$^2$ |
| Compound i | 100 mg/m$^2$ |

Formula 7 (Hydrophobic polymer layer)

| | |
|---|---|
| Latex (methylmethacrylate:acrylic acid = 97:3) | 1.0 g/m$^2$ |
| Hardener g | 6 mg/m$^2$ |

Formula 8 (Backing Protective Layer)

| | |
|---|---|
| Gelatin | 0.4 g/m$^2$ |
| Mating agent, monodispersed methylmethacrylate (Av. particle size of 5 $\mu$m) | 50 mg/m$^2$ |
| Sodium di-(2-ethylhexyl)sulfosuccinate | 10 mg/m$^2$ |
| Surfactant h | 1 mg/m$^2$ |
| Dye k | 20 mg/m$^2$ |
| H—$(OCH_2CH_2)_{68}$—OH | 50 mg/m$^2$ |
| Hardener j | 20 mg/m$^2$ |

AD-1

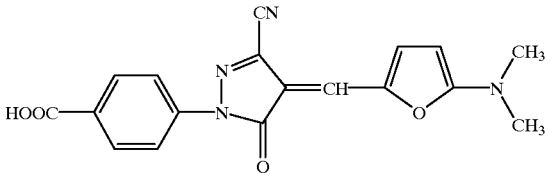

Compound S-1

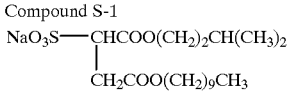

Dye a

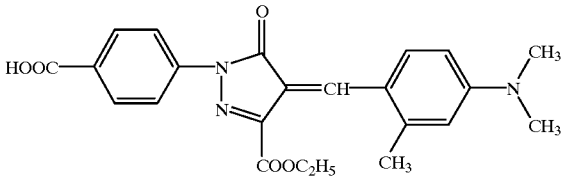

Sensitizing dye d-1

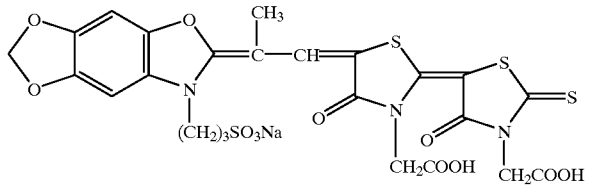

Sensitizing dye d-2

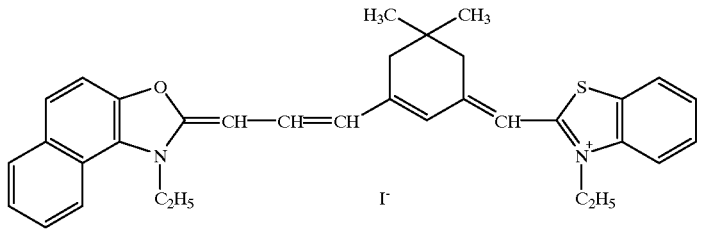

-continued
Hydrazine derivative HY-1
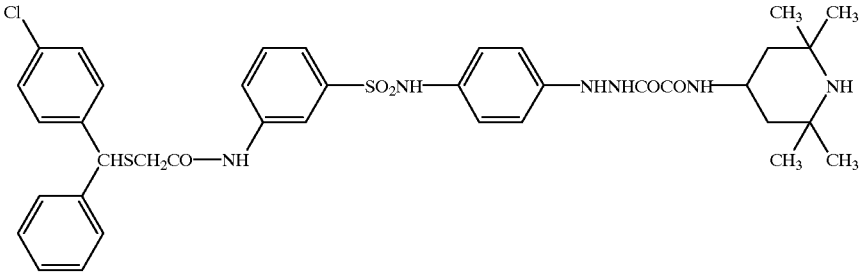
Nucleation accelerating agent AM-1
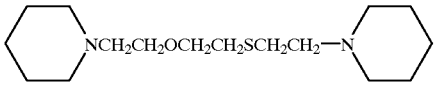
Redox compound RE-1
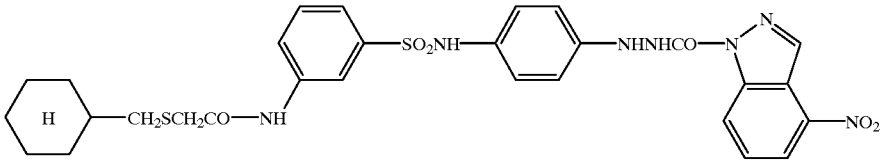
Compound e
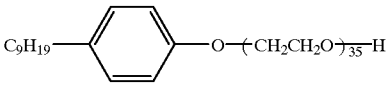
Latex polymer f
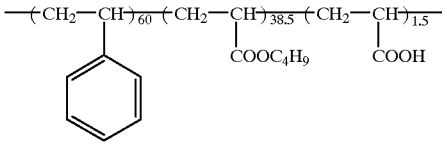
Hardener g
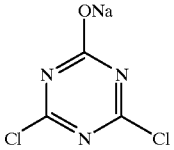
Hydrazine derivative HY-2
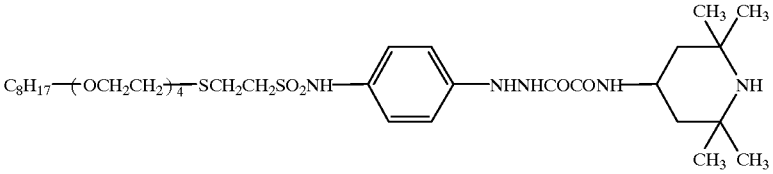
Dye b
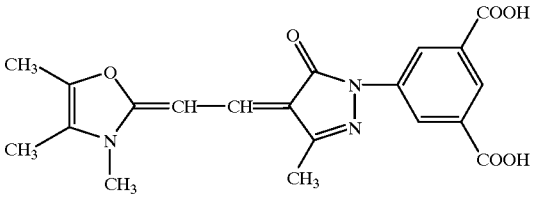
Surfactant h
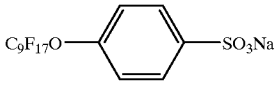

-continued

Hardener j

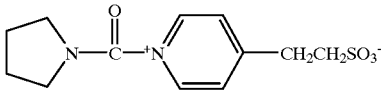

Compound i

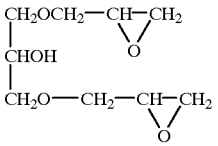

Dye k

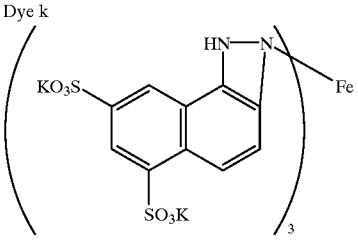

Developer Starting Solution for 1 liter of Working Solution

| | |
|---|---|
| Water | 300 ml |
| DTPA.5Na | 1.45 g |
| Sodium sulfite | 52 g |
| Potassium carbonate | 55 g |
| 8-Mercaptoadenine | 0.06 g |
| Diethylene glycol | 50 g |
| 5-Methylbenzotriazole | 0.21 g |
| 1-phenyl-5-mercaptotetrazole | 0.03 g |
| Dimezone S | 0.87 g |
| Hydroquinone | 20 g |
| Water to make | 400 ml |

The pH was adjusted with KOH (50% aqueous solution). Water of 600 ml and the above concentrated solution ere mixed to prepare a working solution (pH, 10.4). Preparation of Replenishing Developer Granular Developer A-part (for 1 liter of a working solution)

| | |
|---|---|
| DTPA.5Na | 4.35 g |
| Sodium carbonate | 28.77 g |
| Potassium carbonate | 37.5 g |
| Potassium bromide | 2.0 g |
| Sodium sulfite | 49.5 g |
| $LiOH.H_2O$ | 8.8 g |
| D-mannitol (trade name, available from Kao) | 11.7 g |
| D-sorbitol | 5 g |

Materials described above were mixed in a commercially available bandom mill for 30 min., the mixture was granulated with the addition of water in an amount as shown in the Table, using a commercial available stirring granulator (V=10 liters, L=0.5 m, and t=0.05) with stirring for 5 min. at a rotational speed as shown in the Table, and then were dried at 60° C. in a fluidized bed dryer until reached a moisture content of 1% to obtain granulates A.

Granular Developer B-part (for 1 liter of a working solution)

| | |
|---|---|
| 8-Mercaptoadenine | 0.09 g |
| Dimezone S | 1.3 g |
| 5-Methylbenzotriazole | 0.26 g |
| Sodium sulfite | 7.1 g |

-continued

| | |
|---|---|
| Sodium erysorbate | 6 g |
| Hydroquinone | 24 g |
| D-sorbitol | 5.0 g |

Materials described above were mixed in a commercially available bandom mill for 30 min., the mixture was granulated with the addition of water in an amount as shown in the Table, using a commercial available stirring granulator (V=10 liters, L=0.5 m, and t=0.05) with stirring for 5 min. at a rotational speed as shown in the Table, and then were dried at 60° C. in a fluidized bed dryer until reached a moisture content of 2% to obtain granulates B.

Fixer Starting Solution for 1 liter of Working Solution

| | |
|---|---|
| Water | 120 ml |
| Ammonium thiosulfate (10% Na salt, available from Hoechst) | 140 g |
| Sodium sulfite | 22 g |
| Tartaric acid | 3 g |
| Sodium gluconate in an amount as shown in the Table | |
| Sodium acetate.trihydride | 37.8 g |
| Acetic acid (aqueous 90% solution) | 13.5 g |
| Aluminum sulfate.octadecahydride | 18 g |

Water was further added to make 333 ml and the pH was adjusted to 4.81 with sulfuric acid solution(50% aqueous solution). Water of 667 ml and the above concentrated solution ere mixed to prepare a working solution (pH, 4.85). Preparation of Replenishing Fixer Granular Fixer A-part (for 1 liter of a working solution)

| | |
|---|---|
| Ammonium thiosulfate (10% Na salt, available from Hoechst) | 140 g |
| Sodium bisulfite | 14 g |
| Sodium sulfite | 1.0 g |
| Sodium acetate.trihydride | 18 g |
| Pine Flow (trade, available from Matsugaya Kagaku Corp.) | 9 g |

Materials described above were mixed in a commercially available bandom mill for 30 min., the mixture was granulated with the addition of water in an amount as shown in the Table, using a commercial available stirring granulator (V=10 liters, L=0.5 m, and t=0.05) with stirring for 5 min. at a rotational speed as shown in the Table, and then were dried at 60° C. in a fluidized bed dryer until reached a moisture content of 1% to obtain granulates A.

Granular Fixer B-part (for 1 liter of a working solution)

| | |
|---|---|
| Tartaric acid | 3 g |
| Sodium gluconate in an amount as shown in the Table | |
| Succinic acid | 13.2 g |
| Aluminum sulfate.octadecahydride | 18 g |
| Sodium acetate | 10 g |
| D-mannitol | 2.5 g |
| D-sorbit | 1.2 g |
| Macrogoal PEG #4000 | 0.75 g |

Materials described above were mixed in a commercially available bandom mill for 30 min., the mixture was granulated with the addition of water in an amount as shown in the Table, using a commercial available stirring granulator (V=10 liters, L=0.5 m, and t=0.05) with stirring for 5 min. at a rotational speed as shown in the Table, and then were dried at 60° C. in a fluidized bed dryer until reached a moisture content of 1% to obtain granulates B.

To each of granular developer, part A and part B were added sodium 1-octanesulfonate of 1.3 g and 0.4 g per liter of a processing solution, respectively. After mixing, the mixture was subjected to compression-tableting at 1.5 ton/m2, using a commercial tableting machine, machina UD·DFE30·40 (available from Machina Corp.), to obtain tablets having a diameter of 30 mm, a thickness of 10 mm and a weight of 10 g.

To each of granular fixer, part A and part B were added sodium 1-octanesulfonate of 3 g and 0.5 g per liter of a processing solution, respectively. After mixing, the mixture was subjected to compression-tableting at 1.5 ton/m2, using a commercial tableting machine, Machina UD·DFE30·40 (available from Machina Corp.), to obtain tablets having a diameter of 30 mm, a thickness of 10 mm and a weight of 10 g.

The thus prepared developer composition (16 tablets of A and 46 tablets of B) and fixer composition (76 tablets of A and 20 tablets of B) were each put into a aluminum foil package and allowed to stand at ordinary temperature for 1 week.

The tablets above described were dissolved in water using a mixer to prepare a replenishing solution. The pH of a developer replenishing solution and fixer replenishing solution were 10.72 and 4.2, respectively.

The photographic material of 2,000 sheets with a size of 508×610 mm, in which 20% of the total area was exposed, was continuously processed using a processor at a developer replenishing rate of 190 ml/m$^2$ and a fixer replenishing rate of 190 ml/m$^2$. The processor was GR-26SR (available from Konica Corp.), in which replenishing sections of the developer and fixer baths were modified so as to enable to supply the solid developer and fixer compositions.

Processing Condition

| Step | Temperature | Time |
|---|---|---|
| Developing | 35° C. | 30 sec. |
| Fixing | 34° C. | 20 sec. |

-continued

| Step | Temperature | Time |
|---|---|---|
| Washing | Ordinary temp. | 20 sec. |
| Drying | 45° C. | 20.sec. |

Evaluation

Hardness 30 arbitrarily selected tablets of each solid processing composition were measured with respect to hardness using a commercial hardness tester, TS-50 (available from OKADA SEIKO), and the averaged value thereof was defined as a hardness of the tablets. It was proved that tablets with a hardness of not less than 40 kg caused no fracture or produced no dust during transportation.

Abrasion 5 arbitrarily selected tablets of each solid processing composition were subjected to an abrasion test for 5 min. using a tablet abrasion-testing machine available from Irikakogyo Corp., and abrasion was determined from the difference in weight between before and after testing ($W_0$, W). Thus, abration was defined as $(W_0-W)/W_0$. Measurement was repeated 5 times and the average value was defined as an abrasion degree of the tablets. The abrasion degree of 3% or less was a good level, resulting in no dust.

Stains on Rollers and Precipitation in a Developing Bath

After running processing, processed photographic materials were evaluated with respect to stains or precipitations occurring inside of the developing bath and on rollers, based on the following criteria.

A: No stain nor precipitation were observed;

B: Slight stains on rollers were observed, but no problems in practice of processing;

C: Slight stains and precipitates were observed on rollers;

D: Stains and precipitates were observed on rollers, slight adhesion to film led to slight flaws, further, suspended precipitates were observed in the fixing bath; and E: Marked stains and precipitates were observed on rollers, their adhesion to film led to flaws, and precipitates were observed on the bottom of a fixing bath.

Of these, A and B were acceptable levels for practical use.

Drying Speed

After completing running process, 20 sheets of the photographic material films were further continuously processed and evaluated by physically touching the processed photographic materials to determine their dryness, based on the following criteria:

a: Completely dry;

b: Completely dried, but slightly cool;

c: Dried, but slightly moist;

d: Moist and easily adhered to another film sheet;

e: r moisten.

Of these, a, b and c are acceptable levels for practical use. Results are shown in the Table.

TABLE 1-a

| | Bulk density | | | | Water | Rota- | Gluco- |
|---|---|---|---|---|---|---|---|
| | Devel-oper A | Devel-oper B | Fixer A | Fixer B | content (wt %) | tion No. (rpm) | nic acid (mol/l) |
| 1 | 0.8 | 0.82 | 0.95 | 0.7 | 0.5 | 400 | 0 |
| 2 | 0.91 | 0.87 | 0.93 | 0.78 | 0.8 | 300 | 0 |
| 3 | 0.75 | 0.95 | 0.93 | 0.82 | 1 | 500 | 0.03 |
| 4 | 0.98 | 0.85 | 0.88 | 0.95 | 1.5 | 700 | 0.05 |
| 5 | 1.01 | 0.95 | 0.98 | 1.05 | 2 | 1000 | 0.005 |
| 6 | 1.03 | 1 | 1 | 1.07 | 3 | 50 | 0.007 |
| 7 | 1.51 | 1.52 | 1.41 | 1.47 | 6 | 100 | 0.005 |
| 8 | 1.11 | 1.19 | 1.21 | 1.12 | 4 | 70 | 0.04 |
| 9 | 1.41 | 1.48 | 1.42 | 1.42 | 4 | 150 | 0.07 |
| 10 | 1.15 | 1.12 | 1.12 | 1.1 | 5 | 200 | 0.03 |
| 11 | 1.29 | 1.22 | 1.26 | 1.25 | 5.5 | 200 | 0.04 |
| 12 | 1.22 | 1.18 | 1.28 | 1.3 | 4 | 300 | 0.03 |
| 13 | 1.12 | 1.19 | 1.32 | 1.28 | 6 | 300 | 0.035 |
| 14 | 1.1 | 1.3 | 1.18 | 1.15 | 4.5 | 250 | 0.05 |

TABLE 1-b

| | Developer-A | | Developer-B | | Fixer-A | | Fixer-B | | | | |
|---|---|---|---|---|---|---|---|---|---|---|---|
| | Hard-ness (kg) | Abra-sion (%) | Hard-ness (kg) | Abra-sion (%) | Hard-ness (kg) | Abra-sion (%) | Hard-ness (kg) | Abra-sion (%) | Stain on roller | Dry-ing speed | Re-mark |
| 1 | 12 | 7.2 | 25 | 6 | 30 | 4.5 | 12 | 3.3 | E | e | Comp. |
| 2 | 19 | 8.3 | 29 | 7.5 | 17 | 4.2 | 18 | 3.7 | D | d | Comp. |
| 3 | 7 | 13.8 | 28 | 8 | 29 | 4 | 16 | 3.5 | D | d | Comp. |
| 4 | 18 | 12 | 30 | 9 | 22 | 3.5 | 18 | 3.9 | C | d | Comp. |
| 5 | 20 | 11.5 | 22 | 6.6 | 21 | 3.8 | 14 | 4.2 | E | d | Comp. |
| 6 | 21 | 16 | 24 | 7.2 | 15 | 3.9 | 13 | 4.1 | D | e | Comp. |
| 7 | 48 | 2.5 | 58 | 2.8 | 52 | 2.5 | 59 | 1.5 | B | b | Inv. |
| 8 | 42 | 2.8 | 44 | 2.6 | 46 | 2.7 | 45 | 2.2 | B | c | Inv. |
| 9 | 52 | 2.3 | 60 | 2.4 | 56 | 2 | 51 | 1.8 | B | b | Inv. |
| 10 | 70 | 0.4 | 70 | 0.8 | 63 | 0.1 | 81 | 0.3 | A | a | Inv. |
| 11 | 66 | 0.5 | 65 | 0.9 | 64 | 0.2 | 85 | 0.5 | A | a | Inv. |
| 12 | 68 | 0.6 | 60 | 1.1 | 69 | 0.1 | 82 | 0.6 | A | a | Inv. |
| 13 | 90 | 0.8 | 62 | 1.2 | 72 | 0.2 | 84 | 0.8 | A | a | Inv. |
| 14 | 88 | 1.5 | 63 | 1.1 | 73 | 0.1 | 65 | 0.4 | B | a | Inv. |

As can be seen from Table 1-b, inventive samples led to improved results.

What is claimed is:

1. A method for preparing a solid processing composition in the form of granules for a silver halide light sensitive black-and-white photographic material, said method comprising the steps of:

(i) mixing powdery photographic processing chemicals, (ii) granulating a mixture of the processing chemicals while stirring to form granules, and (iii) drying the granules, wherein in step (ii), granulation is carried out with the addition of water in an amount of 4 to 6% by weight, based on the processing chemicals, while stirring at a rate of 100 to 300 rpm; said granules having a bulk density of not less than 1.1 g/cm$^3$.

2. The method of claim 1, wherein said granules have an average particle size of 100 $\mu$m to 800 $\mu$m.

3. The method of claim 1, wherein said solid processing composition in the form of granules is further subjected to compression-molding to form tablets.

4. The method of claim 1, wherein said solid processing composition in the form of granules is a developing composition or a fixing composition.

5. The method of claim 1, wherein said solid processing composition in the form of granules contains gluconic acid or its derivative.

* * * * *